United States Patent [19]

Kamogawa et al.

[11] Patent Number: 4,970,430

[45] Date of Patent: Nov. 13, 1990

[54] FLUORESCENT DISPLAY APPARATUS

[75] Inventors: Hiroshi Kamogawa; Kazunori Tatsuda, both of Mie; Zenichiro Hara; Norihiro Ichikawa, both of Nagasaki; Shuji Iwata, Hyogo; Nobuo Terazaki, Nagasaki, all of Japan

[73] Assignees: ISE Electronics Corporation, Ise; Mitsubishi Denki Kabushiki Kaisha, Tokyo, both of Japan

[21] Appl. No.: 330,069

[22] Filed: Mar. 29, 1989

[30] Foreign Application Priority Data

| | | | |
|---|---|---|---|
| Mar. 31, 1988 | [JP] | Japan | 63-79515 |
| Mar. 31, 1988 | [JP] | Japan | 63-79516 |
| Mar. 31, 1988 | [JP] | Japan | 63-79519 |
| Mar. 31, 1988 | [JP] | Japan | 63-79520 |

[51] Int. Cl.[5] ..... H01J 63/02; H01J 63/06

[52] U.S. Cl. ..... 313/495; 315/169.2

[58] Field of Search ..... 313/495, 497, 422; 315/366, 169.2

[56] References Cited

U.S. PATENT DOCUMENTS

| | | | |
|---|---|---|---|
| 4,525,653 | 6/1985 | Smith | 313/422 X |
| 4,692,663 | 8/1987 | Kobayashi et al. | 313/495 |
| 4,893,056 | 1/1990 | Hara et al. | 313/495 |

FOREIGN PATENT DOCUMENTS

| | | | |
|---|---|---|---|
| 3529041 | 2/1987 | Fed. Rep. of Germany | 313/422 |
| 57-189452 | 11/1982 | Japan . | |
| 58-133753 | 8/1983 | Japan . | |
| 62-10849 | 1/1987 | Japan . | |

*Primary Examiner*—Palmer C. DeMeo

*Attorney, Agent, or Firm*—Burns, Doane, Swecker & Mathis

[57] ABSTRACT

A fluorescent display apparatus as a constituent of picture elements of a large-screen display apparatus which is provided with control electrodes for controlling courses of thermoelectrons emitted from cathodes, thereby decreasing fluctuation in brightness of a fluorescent display cell emitting light upon being bombarded by the electrons and preventing the electrons from bombarding other than predetermined fluorescent display cell with result of no emission of false light.

13 Claims, 8 Drawing Sheets

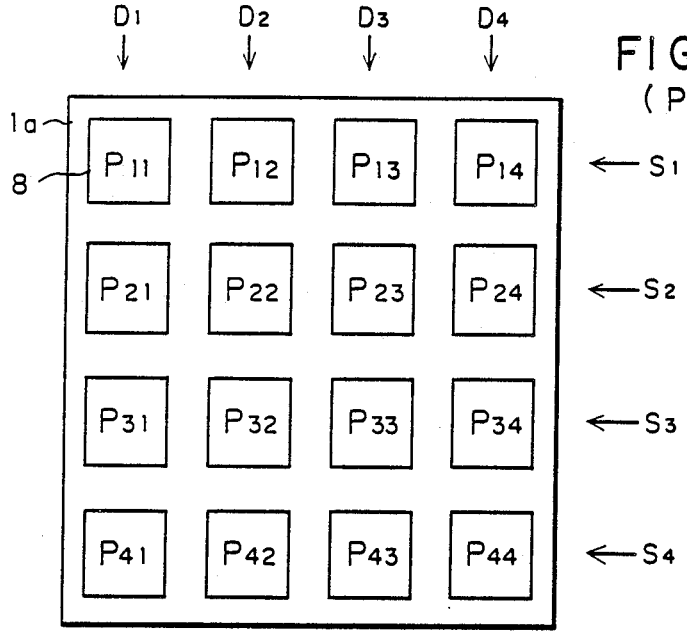
FIG. 5
(PRIOR ART)
FIG. 6
(PRIOR ART)
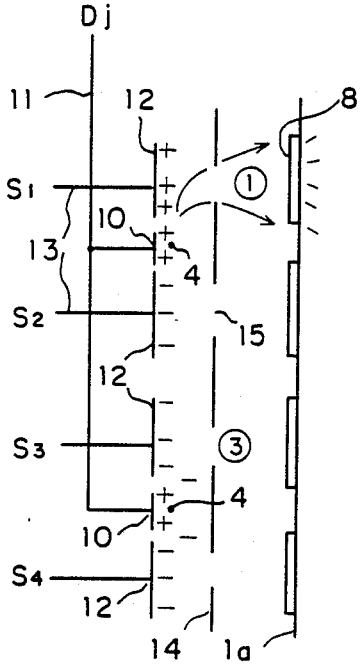
FIG. 7
(PRIOR ART)
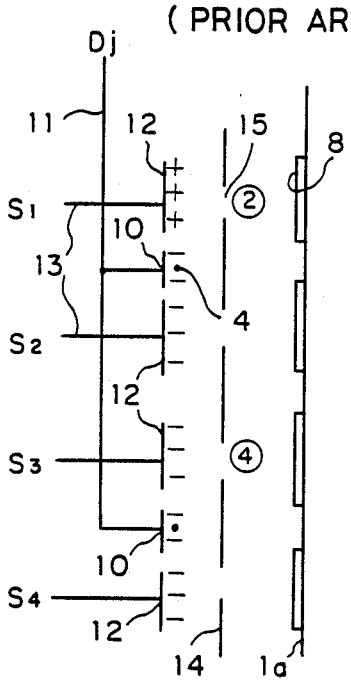

FLUORESCENT DISPLAY APPARATUS

BACKGROUND OF THE INVENTION

1. Field of the Invention

The present invention relates to a fluorescent display apparatus constituting a large-screen display for use in a stadium or the like.

2. Description of the Prior Art

FIG. 1 is a sectional view showing a prior art fluorescent display apparatus disclosed, for example, in U.S. Pat. No. 4,893,056 and FIG. 2 is an exploded perspective view of the same. Referring to FIG. 1 and FIG. 2, reference numeral 1*a* denotes a display screen shaped in the form of a flat plate and having sixteen fluorescent display cells 8, 1*b* denotes a frame body forming side faces of a vacuum envelope of the fluorescent display apparatus, 8A denote accelerating anodes disposed so as to surround the fluorescent surface of the fluorescent display cells 8, 14 denotes a planar electrode as a first control electrode made in the form of a flat plate, and 1*c* denotes a substrate with such components as cathodes 4, second and third control electrodes 10, 12 , and their wiring leads 11, 13 disposed thereon, 40 denotes a lead. The fluorescent display apparatus is constructed by providing the planar electrode 14 in the space surrounded by the frame member 1*b* and by fixing the display screen 1*a* on one end of the frame body 1*b* and fixing the substrate 1*c* on the other end of the frame body 1*b*.

The display screen la is provided with sixteen fluorescent display cells 8 coated with phosphor and arranged in a matrix (4 rows by 4 columns) thereon. Each fluorescent display cell 8 is supplied with a high voltage and adapted to emit light by being bombarded with electrons. In the planar electrode 14, there are made sixteen openings 15 arranged in a matrix (4 rows by 4 columns) corresponding to the fluorescent display cells 8.

FIGS. 3(*a*) and 3(*c* ) are plan view showing electrode structure on the substrate 1*c*, in which the horizontal direction is the direction of the row and the vertical direction is the direction of the column. In the center of the substrate 1*c*, there is made an exhaust hole 2 used as the passage of exhaust air when evacuating the interior of the fluorescent display apparatus. There are four directly heated filament cathodes 4 disposed above the substrate 1*c* slightly spaced from its surface. When a heater current is passed through each cathode 4, thermoelectrons are emitted from the cathode 4.

On the surface of the substrate 1*c* at the portions corresponding to the cathodes 4, there are disposed eight data electrodes, in an array of 2 rows by 4 columns, as the second control electrodes for controlling thermionicemission of the cathodes 4. Each data electrode 10, by being supplied with positive or negative potential relative to the potential of the cathode 4, controls thermionicemission of each corresponding cathode 4. On the surface of the substrate 1*c* at both sides in the direction of the column of each data electrode 10, there are disposed eight scanning electrodes 12, in a matrix of 4 rows by 2 columns, as the third control electrodes for controlling the moving direction of the thermoelectrons emitted from the cathode 4.

The size of the data electrode 10 is made smaller than that of the scanning electrode 12. Of the eight data electrodes 10, two each arranged in the same column are connected together to each of four wiring leads 11 arranged in the direction of the column, and of the eight scanning electrodes 12, two each in the same row are connected together to each of the four wiring leads 13 arranged in the direction perpendicular to the wiring leads 11, that is, in the direction of the row. The wiring leads 11 and the wiring leads 13 are laid down with an insulating layer interposed therebetween so as not to come into contact with each other. These data electrodes 10, scanning electrodes 12, wiring leads 11, and wiring leads 13 are formed on the substrate 1*c* by printing.

Operation will be explained below. Referring to FIGS. 3(*a*), 3(*b* ) and 3(*c*) S1, S2, S3, and S4 indicate scanning signals Applied to two each scanning electrodes 12 in the same row, and D1, D2, D3, and D4 indicate data signals applied to two each data electrodes 10 in the same column. FIG. 4 is a timing chart of the application of the signals S1 to S4, and D1 to D4. FIG. 5 is a diagram showing arrangement in a matrix of the fluorescent display cells 8 formed on the display screen 1*a*. Light emitted from each of the fluorescent display cells 8 is controlled by applying the signals S1 to S4, and D1 to D4.

The operation for controlling the emission of light will now be described.

ON (positive)/OFF (negative) control of each of the data electrodes 10 and ON (positive)/OFF (negative) control of each of the scanning electrodes 12 are performed at the timings of the data signals and scanning signals as shown in FIG. 4. There are four phases of periods in the combinations of the ON/OFF states of the scanning electrode 12 and the ON/OFF states of the data electrode 10 (i.e., where the state of the scanning electrode 12 and the data electrode 10 are ON and ON, ON and OFF, OFF and ON, and, OFF and OFF, respectively). The light emitting condition of the fluorescent display cell in each period will be described below. FIG. 6 and FIG. 7 are schematic diagrams showing states of potential in these four periods.

Where both the scanning electrode 12 and the data electrode 10 are in the ON state, the field in the vicinity of the heated cathode 4 becomes positive under the field of the data electrode 10 and the scanning electrode 12 and hence thermoelectrons are emitted. The emitted thermoelectrons are deflected under the field of the scanning electrode 12 and accelerated by the planar electrode 14 to advance to the corresponding fluorescent display cell 8 and bombard the fluorescent display cell 8. Then, the electrons coming into contact with the phosphor material cause the fluorescent display cell 8 to emit light (FIG. 6 ①).

Where the scanning electrode 12 is in the 0N state and the data electrode 10 is in the OFF state, since the data electrode 10 is disposed closer to the cathode 4, the field of the data electrode 10 affects the cathode 4 more strongly. Hence, in this case, the field in the vicinity of the cathode 4 becomes negative so that the thermionicemission from the cathode 4 is suppressed and the fluorescent display cell 8 does not emit light (FIG. 7 ②).

Where the scanning electrode 12 is in the OFF state and the data electrode 10 is in the ON state, although the data electrode 10 is positive, both the scanning electrodes 12 formed on both sides of the data electrode 10 are negative, and moreover, the size of the scanning electrode 12 is larger than that of the data electrode 10, and hence the field in the vicinity of the cathode 4 becomes negative so that the thermionicemission from the cathode 4 is suppressed and the fluorescent display cell 8 does not emit light (FIG. 6 (3)).

Where both the scanning electrode 12 and the data electrode 10 are in the OFF state, the field in the vicinity of the cathode 4 becomes negative so that the thermionicemission from the cathode 4 is suppressed and the fluorescent display cell 8 does not emit light 10 (FIG. 7 (4)).

In the described manner, the emission of light in each of the fluorescent display cells 8 is controlled at will by combination of the potential of the data electrode 10 and the scanning electrode 12. Since, here, the potential of the data electrode 10 and the scanning electrode 12 is controlled by the data signals D1–D4 and the scanning signals S1–S4, it is made possible to have each of the fluorescent display cells 8 emitting light or not at will by controlling these signals.

Now, when two data electrodes 10, as adjoining two control electrodes, are simultaneously ON, two adjoining fluorescent display cells 8 corresponding thereto emit light, and when only one data electrode 10 is ON, only one of the fluorescent display cells 8 emits light. The difference in the light emission in the fluorescent display cells 8 between these cases is shown in FIG. 8(*a*) and FIG. 8(*b*), wherein four fluorescent display cells 8*a*, 8*b*, 8*c*, and 8*d* controlled by ON/OFF states of the corresponding two data electrodes 10*a* and 10*b* and two scanning electrodes 12*a* and 12*b* are shown. When the data electrodes 10*a* and 10*b* are both turned ON (positive potential) and the scanning electrode 12*a* is turned 0N (positive potential), thermoelectrons from the cathode 4 are deflected by the field of the scanning electrode 12*a* as shown in FIG. 8(*a*) and bombard the corresponding two fluorescent display cells 8*a* and 8*b* causing these two to emit light.

On the other hand, when only the data electrode 10*b* and the scanning electrode 12*a* are ON, the thermoelectrons are deflected so as to bombard only one fluorescent display cell 8*b*, as shown in FIG. 8(*b*), causing the same to emit light. In this way, by controlling the states of potential developed also by the other scanning electrodes 12*a* and 12*b* and the data electrodes 10*a* and 10*b*, one to four of the fluorescent display cells 8*a* to 8*d* can be selectively caused to emit light.

Since the prior art fluorescent display apparatus is constructed as described above, when only one each electrode, i.e., the data electrode 10*b* and the scanning electrode 12*a*, are turned ON, the data electrode 10*a* is held negative, and this causes the region of thermionicemission on the cathode 4 to reduce to about one half as shown in FIG. 8(*b*). Hence, there has been the probability of fluctuation in brightness of the fluorescent display cell 8*b* between a case of both the data electrodes 10*a* and 10*b* being turned ON and the other case of only the data electrode 10*b* being turned ON. There has also been the probability of such difference in brightness, though slightly, from the tolerance of assembling such as positioning of the electrodes or from the fluctuation of an input voltage.

Further, while the data signals D1 to D4 and scanning signals S1 to S4 as shown in FIG. 4 are being applied to the data electrodes 10 and the scanning electrodes 12 as shown in FIG. 6 and FIG. 7, if the polarities of adjoining sets of the electrodes 10 and 12 are as shown in FIG. 9, then the thermoelectrons emitted from one of the cathodes 4 flow normally as indicated by the arrow P, pass through the opening 15 in the control electrode 14, and bombard the predetermined fluorescent display cell 8 to cause it to emit light. However, there has been the probability of a portion of the emitted thermoelectrons flowing also in the direction of the arrow Q and straying into other adjoining openings 15, whereby other than the predetermined fluorescent display cells 8 are caused to emit false light.

Furthermore, there has been the probability of the electric field of a high voltage of the anode 8*a* penetrating through the gap between the frame body 1*b* and the planar electrode 14 and reaching the vicinity of the cathode 4, thereby causing electrons emitted from the cathode 4 to pass through the gap and reach the fluorescent display cells 8 at the circumference of the display screen 1*a* and cause them to emit false light.

SUMMARY OF THE INVENTION

An object of the present invention is to provide a fluorescent display apparatus in which the quantity of thermoelectrons emitted from the cathode when only one data electrode is turned ON, will be increased so that the brightness of the fluorescent display cell at that time is not largely lowered below the brightness thereof when two data electrodes are turned ON.

Another object of the present invention is to provide a fluorescent display apparatus in which the flow of thermoelectrons from a cathode is restrained so that other than the predetermined fluorescent display cell 8 designated as the picture element are not allowed to emit false light.

A further object of the present invention is to provide a fluorescent display apparatus in which stray electrons travelling from cathodes to the display screen 1*a* are fully prevented.

In order to achieve the above enumerated objects, a fluorescent display apparatus according to the present invention comprises within a vacuum envelope thereof a display screen with fluorescent display cells arranged thereon in a matrix, cathodes for emitting electrons disposed corresponding to the fluorescent display cells, a first control electrode with openings corresponding to the fluorescent display cells made therein, second control electrodes disposed, with two thereof arranged corresponding to each cathode and oriented along the length of the cathode, on a substrate which is located on the side of the cathodes opposite to the display screen, and third control electrodes disposed parallel to the cathode at both sides in the direction of the column of the second control electrodes, wherein, in order to reduce the difference in brightness, there are provided fourth control electrodes, with one each thereof disposed between the two second control electrodes, for expanding the region of thermionicemission of the cathode and thereby increasing the brightness.

Further, in a fluorescent display apparatus according to the present invention, there are provided back shield electrodes disposed between units, with a unit defined as composed of one cathode, and two second control electrodes and two third control electrodes corresponding to the cathode, or there are provided side shield electrodes between the first control electrode and the substrate of the vacuum envelope, and thereby, thermoelectrons from the cathodes are prevented from straying into any other than the predetermined fluorescent display cells to avoid the emission of false light. Furthermore, in a display tube for light source according to the present invention, the cathodes, second control electrodes, and third control electrodes are provided on an insulating substrate arranged to be floating above a back plate of the vacuum envelope, and the first control electrode is formed to have a crosssection in a U-shape and the edge portions thereof are extended so as to surround the insulating substrate and reach the vicinity of the back plate, and thereby, thermoelectrons from the cathodes under the influence of the anode voltage are prevented from reaching any other fluorescent display cells than the designated one.

BRIEF DESCRIPTION OF THE DRAWINGS

FIG. 5 is a plan view schematically showing a display screen;

FIG. 6 and FIG. 7 .are diagrams schematically showing potential in the vicinity of cathodes;

DETAILED DESCRIPTION OF THE PREFERRED EMBODIMENTS

A preferred embodiment of the present invention will be described below in detail with reference to the accompanying drawings.

Figure 10:
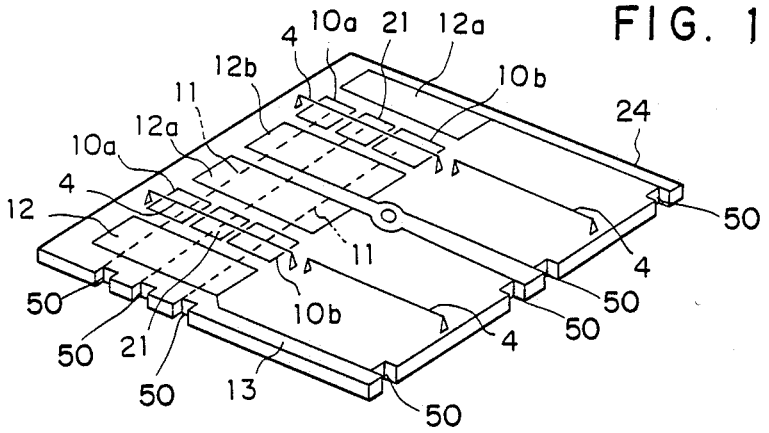
FIG. 10 is a perspective view showing a substrate of a fluorescent display apparatus according to a first embodiment of the present invention.
Figure 11A:
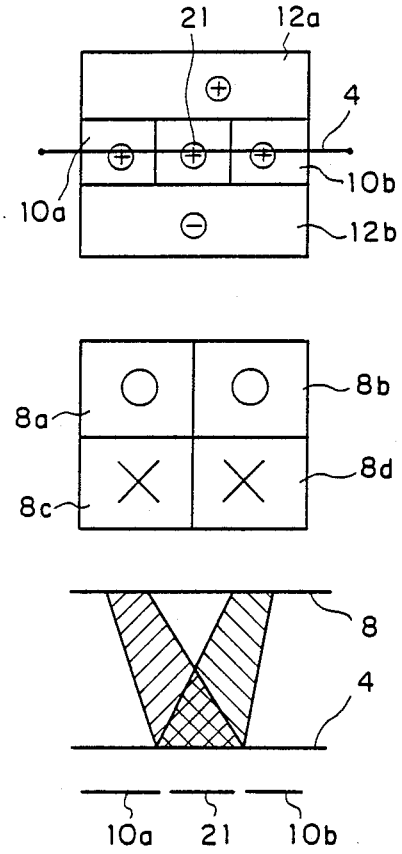
FIGS. 11*a* and 11*b* are explanatory drawings showing relationships between polarities of data electrodes and scanning electrodes and the distribution of thermoelectrons from a cathode.
Figure 11B:
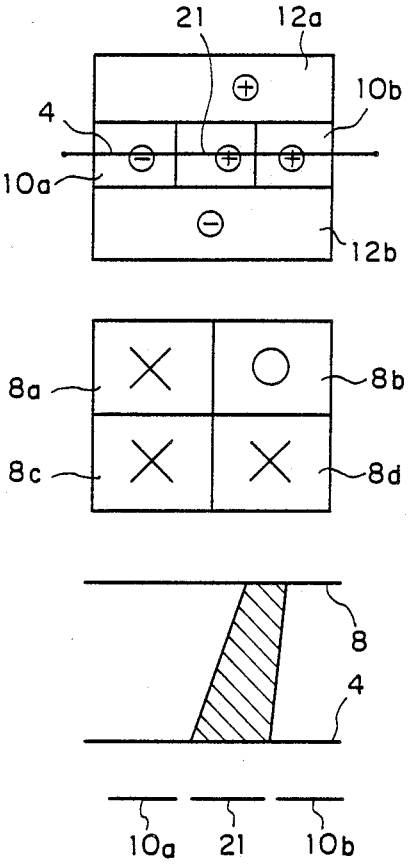

Referring to FIG. 10, reference numeral 1*d* denotes a substrate, and on the substrate 1*d*, there are disposed cathodes 4, data electrodes 10*a*, 10*b* as second control electrodes, scanning electrodes 12*a*, 12*b* as third control electrodes, and electrodes 21, located between the data electrodes 10*a* and 10*b*, and between the scanning electrodes 12*a* and 12*b* as fourth control electrodes supplied with potential at a predetermined level for reducing fluctuation in brightness. Above the substrate 1*c*, there are provided a planar electrode 14 as first control electrode and a display screen 1*a* with predetermined spacings between one another, and these are contained in an insulating substrate 24. There are provided cut grooves 50 with peripheral edge portion of the insulating substrate 24. FIG. 11 is an explanatory drawing showing a difference in emission of light between the periods where both data electrodes are turned ON and one data electrode is turned ON in a fluorescent display apparatus with the electrode arrangement as described above.

Operation will be described below.

Figure 8A:
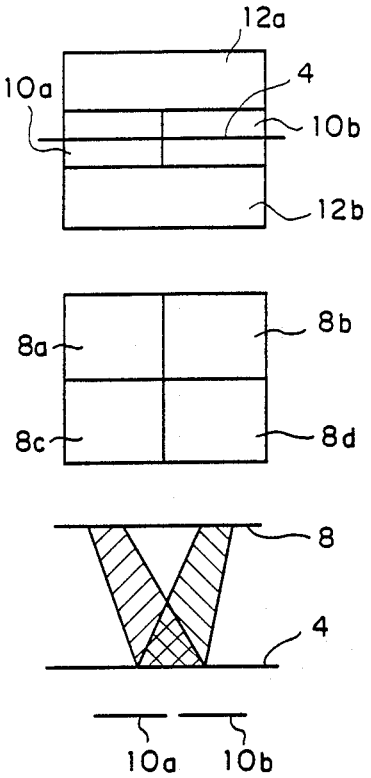
FIG. 8(a) (PRIOR ART)
FIGS. 8*a* and 8*b* are explanatory drawings showing relationships in the prior art between polarities of data electrodes and scanning electrodes and the distribution of thermoelectrons from a cathode.
Figure 8B:
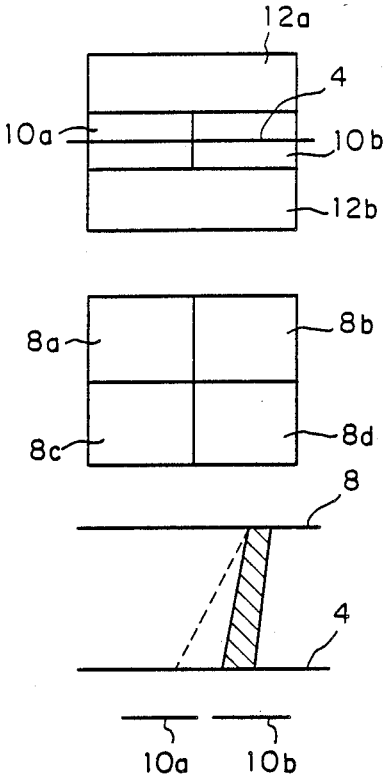
FIG. 8(b) (PRIOR ART)

In the region of thermionicemission on the cathode 4, when both the data electrodes 10*a*, 10*b* are turned 0N and the scanning electrode 12*a* is turned ON, the thermoelectrons are deflected as shown in FIG. 11(*a*), virtually in the same way as in the case shown in FIG. 8(*a*), whereby corresponding two fluorescent display cells 8*a*, 8*b* are both bombarded by the electrons to emit light. On the other hand, when only one data electrode 10*b* and the scanning electrode 12*a* are turned ON, the region of thermionicemission on the cathode 4 includes the portion corresponding to the fourth control electrode 21, and therefore, it is expanded, as shown in FIG. 11(*b*), to virtually two times larger than that in the prior art. As a result, the thermoelectrons from such a wider region are deflected to bombard one fluorescent display cell 8*b* causing it to emit light. Hence, its brightness becomes much higher than that in the prior art as shown in FIG. 8(*b*), reducing the difference in brightness between this and that of the fluorescent display cell 8*b* in the case where the fluorescent display portions 8*a*, 8*b* are both allowed to emit light, and thus an improvement is obtained such that the difference in brightness is made virtually undetectable by vision. Similarly, when using other fluorescent display cells 8*c*, 8*d* separately from or jointly with the fluorescent display cells 8*a*, 8*b* to selectively cause one to four of them to emit light, it becomes possible to reduce the difference in brightness by holding the fourth control electrode 21 ON and thereby obtain a well-balanced and good image display.

Such a fourth control electrode 21 also has a performance to reduce the fluctuation in brightness resulting from a tolerance of electrode positioning or assembling.

Figure 3A:
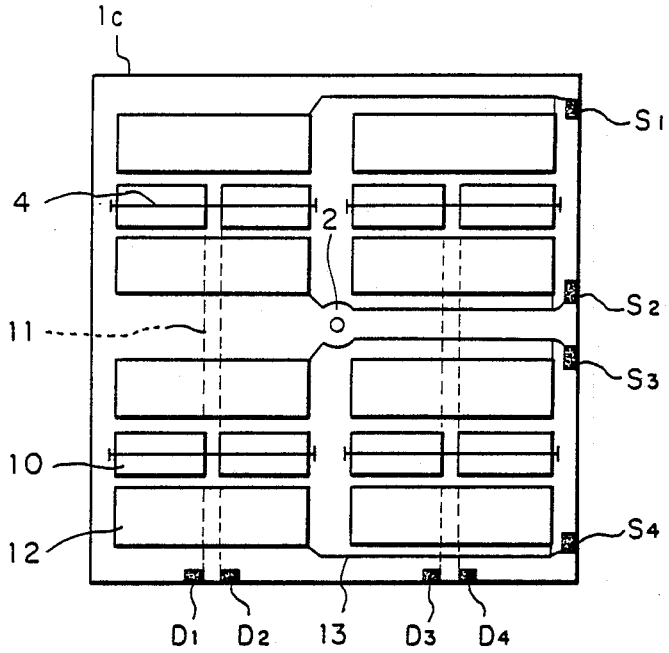
FIG.3(a) (PRIOR ART)
FIG. 3*a,b,* and *c* are plan views showing electrode structure.
Figure 3B:
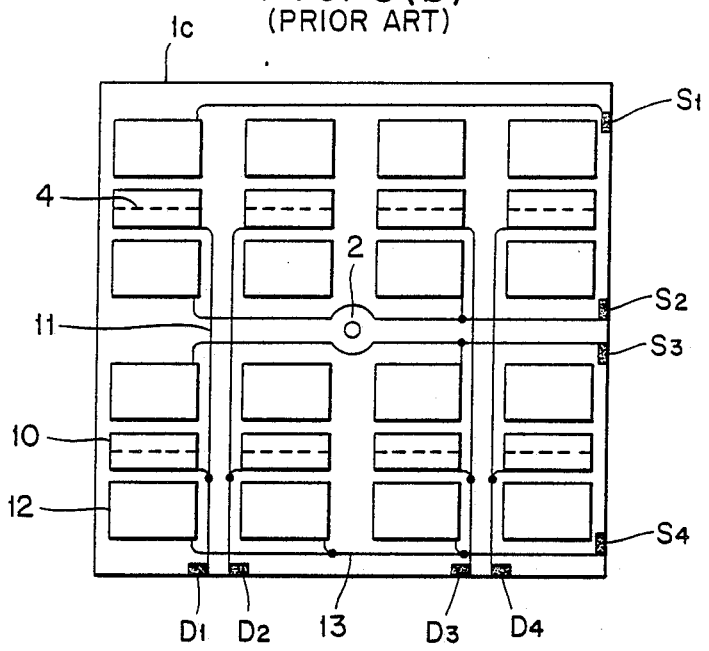
FIG. 3(b) (PRIOR ART)
Figure 3C:
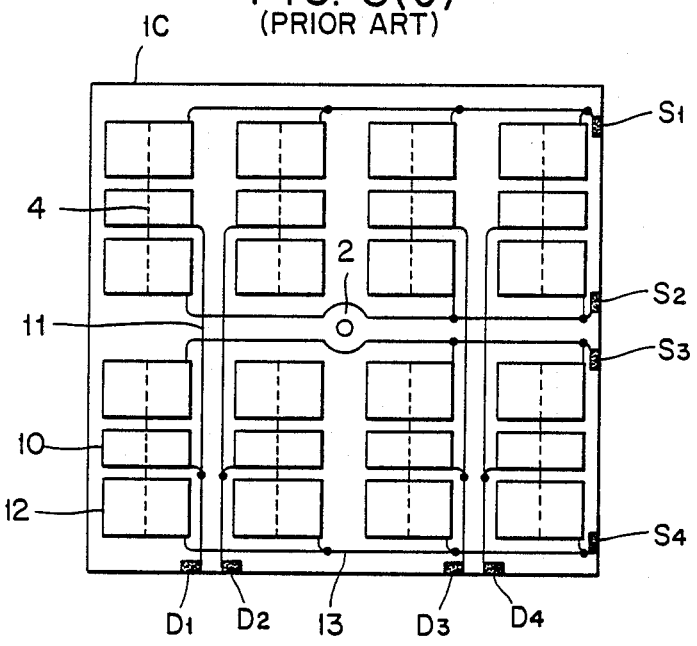
FIG. 3(c) (PRIOR ART)
Figure 12:
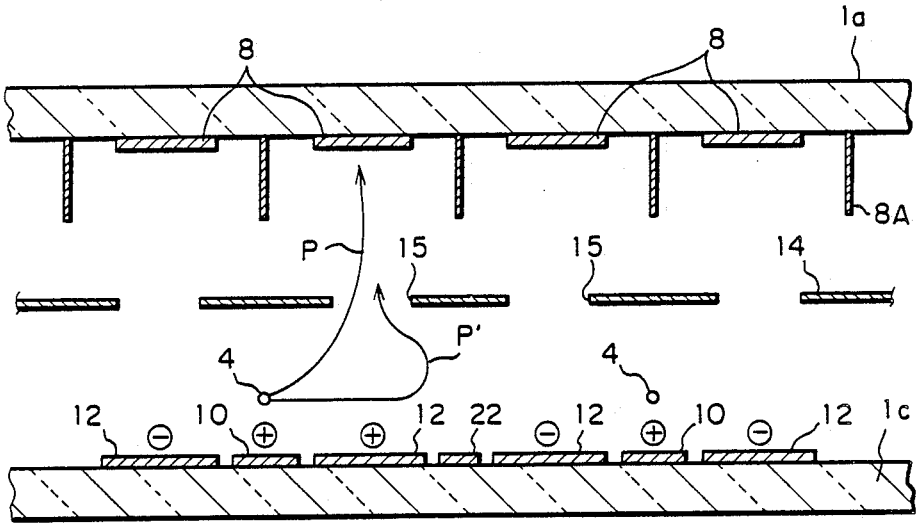
FIG. 12 is a sectional view showing the flow of thermoelectrons emitted from a cathode in a fluorescent display apparatus according to a second embodiment of the present invention.

FIG. 12 is a drawing showing a second embodiment of the present invention. Referring to FIG. 12, reference numeral 22 denotes a back shield electrode provided on the substrate 1*c*. Defining a unit as composed of one cathode 4, two data electrodes 10 as second control electrodes positioned under and facing the cathode 4, and two scanning electrodes 12 as third control electrodes disposed on both sides in the direction of the column of the data electrodes, four back shield electrodes 22 are disposed between each two adjoining units of four such units. The back shield electrode 22 are, for example, formed out of carbon by screen-printing on the substrate 1*c*. Other components corresponding to those shown in FIGS. 3(*a*), 3(*b*) and 3(*c*) are denoted by corresponding reference numerals and duplicated explanation thereof is omitted here.

Operation will be described below.

In the present embodiment, as described above, there are disposed the back shield electrodes 22 between each of adjoining units. Hence, by keeping the potential of the back shield electrode 22 at a zero or negative potential level at all times, the thermoelectrons emitted from the cathode 4 in one unit likely straying into the adjoining unit are affected by the zero or negative potential of the back shield electrode and thereby deflected as shown by the arrow P'. Thus, it does not occur that the thermoelectrons emitted from the cathode 4 of one unit will stray into the opening 15 in the planar electrode 14 corresponding to other units as was the case in the prior art, and therefore, the probability of emission of false light at the fluorescent display cells 8 in other units due to such stray electrons can be thus eliminated. As a result, each of the adjoining units effects the emission of light on the fluorescent display cell 8 by its own thermoelectrons and a good image display is ensured.

Figure 13:
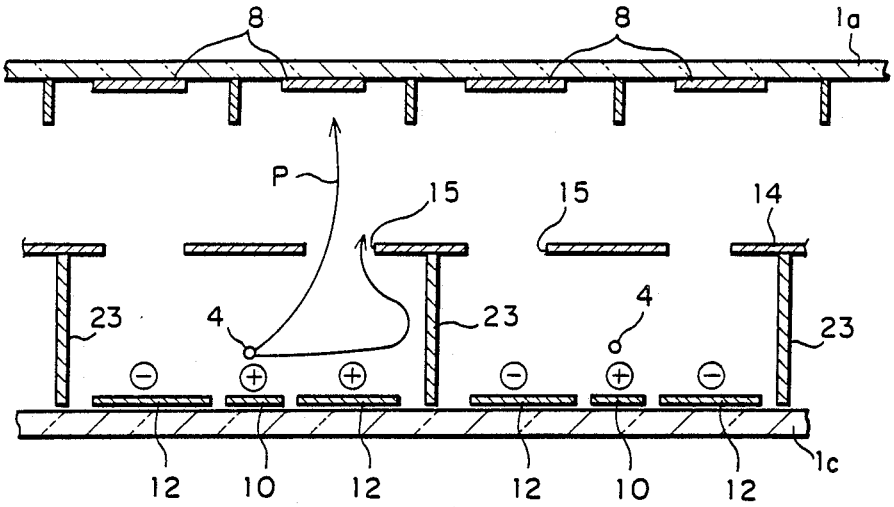
FIG. 13 is a sectional view showing a principal portion of a fluorescent display apparatus a third embodiment of the present invention.
Figure 9:
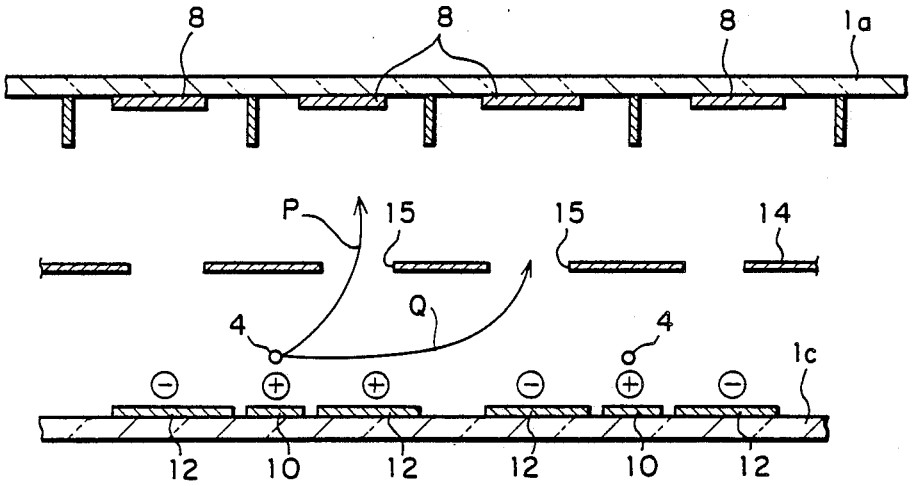
FIG. 9 (PRIOR ART)
FIG. 9 is a sectional view of a prior art fluorescent display apparatus showing the flow of thermoelectrons from a cathode.

FIG. 13 is a drawing showing a third embodiment of the present invention. Referring to FIG. 13, reference numeral 23 denotes a side shield electrode, and these side shield electrodes 23 arc provided between the control electrode 14 and the substrate 1*c* being erected between the cathodes 4, 4. The side shield electrode 23 may be electrically connected at its top edge to the control electrode 14 or isolated therefrom to connect to an earth line instead.

Operation will be described below.

Figure 4:
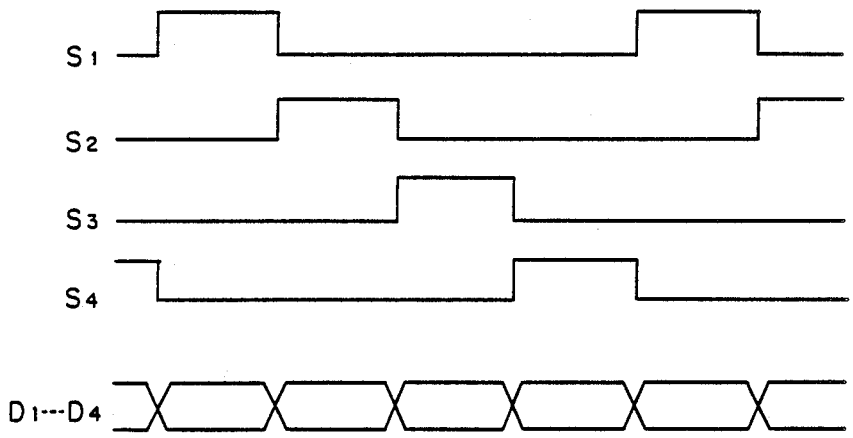
FIG. 4 (PRIOR ART)
FIG. 4 is a diagram schematically showing timing of signals.

First, the data signals D1 to D4 and the scanning signals S1 to S4 as shown in FIG. 4 are supplied to the data electrodes 10 and the scanning electrodes 12 as shown in FIG. 6 and FIG. 7. Supposing now that these electrodes 10, 12 have obtained polarities as shown in FIG. 13, the thermoelectrons emitted from one cathode 4 are allowed to flow normally in the direction indicated by the arrow P and further to pass through the opening 15 in the control electrode 14. Thereby, the fluorescent display cell 8 corresponding to the opening 15 is bombarded by the electrons and emit light.

Meanwhile, some of the thermoelectrons emitted from the cathode 4 moving toward another opening 15 are deflected by the effect, for example, of zero potential or negative potential of the side shield electrode 23 and flow in the direction of the arrow R, and thereby, caused to pass through the opening 15 and be lead onto the same fluorescent display cell 8 as above via the normal route. Consequently, all the thermoelectrons emitted from the cathode 4 are concentrated on the designated fluorescent display cell 8 causing the same to emit light effectively. Thus, deterioration of brightness at the predetermined fluorescent display cell 8 due to straying electrons or emission of false light at other fluorescent display cells 8, can be prevented for certain.

Figure 1:
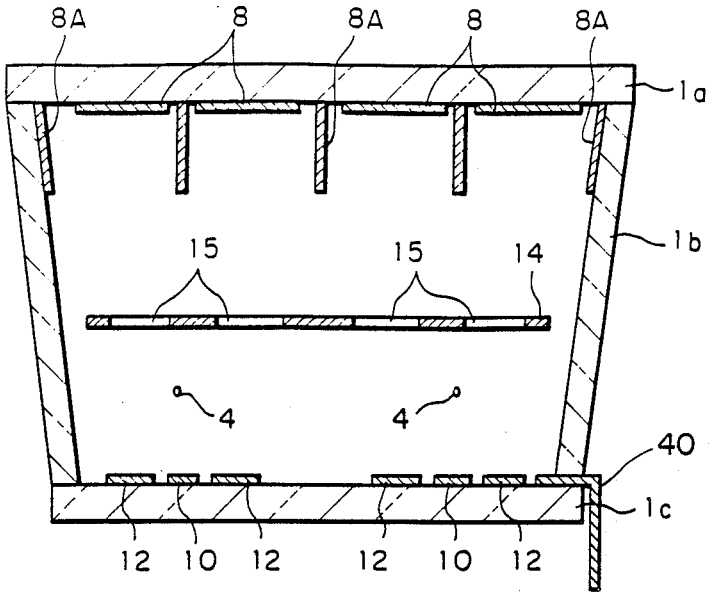
FIG. 1 (PRIOR ART)
FIG. 1 is a sectional view showing a prior art fluorescent display apparatus.
Figure 14:
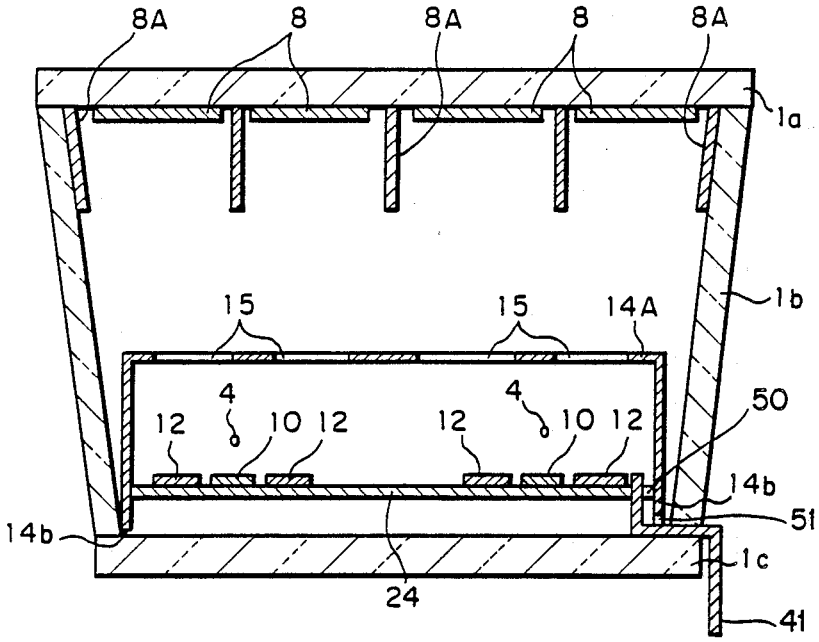
FIG. 14 is a sectional view showing a fluorescent display apparatus according to a fourth embodiment of the present invention.
Figure 2:
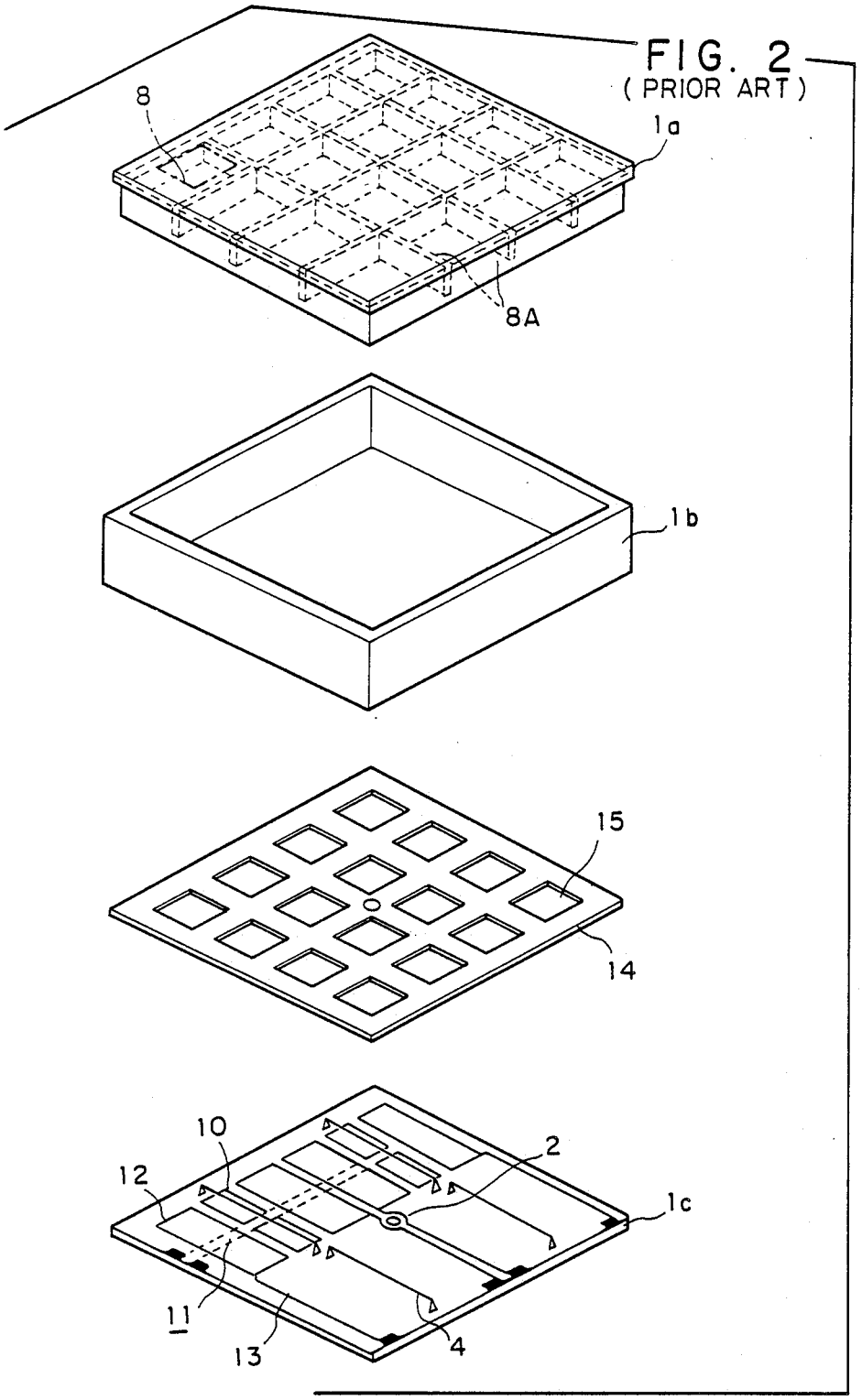
FIG. 2 (PRIOR ART)
FIG. 2 is an exploded perspective view of FIG. 1.

FIG. 14 is a drawing showing a fourth embodiment of the present invention. Referring to FIG. 14, reference numeral 24 denotes an insulating substrate provided within the vacuum envelope in a manner floating above a back plate 1*c*. The insulating substrate 24 is formed out of a ceramic plate, a glass plate, or the like. On the insulating substrate 24, there are provided the cathodes 4, the data electrodes 10, and the scanning electrodes 12 in the same arrangement as in the previous examples. Reference numeral 14A denotes a first control electrode which as a whole has a square form and its circumferential portions are bent so that the thus made bent pieces 14*b* together with the control electrode 14A have a cross-section in a U-shape.

The first control electrode 14A also has openings 15 made therein. The edge portion 14*b* of the first control electrode 14A is arranged to extend past the periphery of the floating insulating substrate 24 as far as the vicinity of the back plate 1*c*.

As shown in FIGS. 10 and 14, a lead 41 from the cathodes 4 and electrodes 10, 12, and 14A are arranged to be taken out on the back side of the back plate 1*c* through a cut 51 made in the edge portion 14*b* of the first control electrode 14A, a cut groove 50 made in the edge portion of the insulating substrate 24, or the like. The first control electrode 14A is provided with zero potential or negative potential.

Operation will be described below.

First, a heater voltage is applied to the cathode 4 so that thermoelectrons are emitted therefrom and a voltage, for example, at 8 KV is applied to the anode 8A. Thereby, electric field of the high-voltage is developed within the vacuum envelope between the fluorescent display cell 8 and the first control electrode 14A, around the anode 8A as the center. At this time, the electric field partly tends to penetrate into the vicinity of the cathode 4 taking the route passing through the minute gap between the edge portion 14*b* of the first control electrode 14A and the back plate 1*c* and the minute gap between this first control electrode 14A and the periphery of the insulating substrate 24.

However, since the route is passing through such minute gaps and the route itself is bent and long, the high-voltage potential is sufficiently attenuated on the midway of the route, so that it hardly reaches the vicinity of the cathode 4. As a result, the stray electrons passing through this route from the cathode 4 to the anode 8A and the fluorescent display cell 8 can be prevented and hence there is no probability of emission of false light at the fluorescent display cells 8.

Although the above described embodiments were all of a four-dot type in which one cathode 4 makes four fluorescent display cells 8 emit light. The same effects as obtained from the above described embodiments can be obtained even if the device is of a two-dot type in which one cathode 4 makes two fluorescent display cells 8 emit light.

What is claimed is:

1. A fluorescent display apparatus having within a vacuum envelope, comprising:

a display screen with fluorescent display cells arranged thereon in a matrix;

cathodes for emitting electrons, said cathodes being disposed corresponding to said fluorescent display cells;

a first control electrode with openings corresponding to said fluorescent display cells made therein and positioned between said display screen and said cathodes;

second control electrodes, corresponding to each of said cathodes and oriented along the length of said cathode, disposed on a substrate which is located on the side of said cathodes opposite to said display screen; and third control electrodes disposed parallel to said cathode at both sides in the direction of the column of said second control electrode;

said second control electrodes corresponding to said cathodes and oriented along the length thereof being provided two in number for each cathode, fourth control electrodes for reducing fluctuation in brightness with each thereof being disposed between said two second control electrodes.

2. A fluorescent display apparatus according to claim 1, wherein said fourth control electrode is supplied with potential at a predetermined level.

3. A fluorescent display apparatus according to claim 1, wherein said fluorescent display apparatus is provided with a display screen having fluorescent display cells arranged thereon in a matrix of 2m rows by 2n columns (m, n being natural members), cathodes arranged in an array of m ross by n columns, shaped in a filar form aligned with the direction of the row, and positioned so as to confront said display screen with each thereof corresponding to four of said fluorescent display cells, a first control electrode shaped in a planar form with $2m \times 2n$ openings corresponding to said fluorescent display cells of said display screen made therein and positioned between said display screen and said cathodes, second control electrodes arranged in an array of m rows by 2n columns, with two thereof corresponding to each cathode and oriented along said cathode, and positioned on the side of said cathodes opposite to said display screen, and third control electrodes arranged in an array of 2m rows by n columns, with two thereof corresponding to each cathode, and positioned at both sides in the direction of the column of two of said second control electrodes.

4. A fluorescent display apparatus having within a vacuum envelope, comprising:

a display screen with fluorescent display cells arranged thereon in a matrix;

cathodes for emitting electrons, said cathodes being disposed corresponding to said fluorescent display cells;

a first control electrode with openings corresponding to said fluorescent display cells made therein and positioned between said display screen and said cathodes;

second control electrodes, corresponding to each of said cathodes and oriented toward said cathode, disposed on a substrate which is located on the side of said cathodes opposite to said display screen;

third control electrodes disposed at both sides of said second control electrode; and back shield electrodes disposed between units, with a unit defined as composed of said cathode, and said second control electrode and said third control electrodes corresponding to said cathode.

5. A fluorescent display apparatus according to claim 4, wherein said back shield electrodes are formed out of carbon on the substrate by screen printing.

6. A fluorescent display apparatus according to claim 4, wherein said back shield electrodes are held at a zero potential or negative potential level at all times.

7. A fluorescent display apparatus having within a vacuum envelope, comprising:

a display screen with fluorescent display cells arranged thereon in a matrix;

cathodes for emitting electrons, said cathodes being disposed corresponding to said fluorescent display cells;

a first control electrode with openings corresponding to said fluorescent display cells made therein and positioned between said display screen and said cathodes;

second control electrodes disposed, corresponding to each of said cathodes and oriented toward said cathode, on a substrate which is located on the side of said cathodes opposite to said display screen;

third control electrodes disposed at both sides of said second control electrode; and side shield electrodes between said cathodes in the space between said first control electrode and said substrate on which the second and the third control electrodes are disposed.

8. A fluorescent display apparatus according to claim 7, wherein said side shield electrodes are electrically connected to said first control electrode.

9. A fluorescent display apparatus according to claim 7, wherein said side shield electrodes are electrically connected to an earth line.

10. A fluorescent display apparatus having within a vacuum envelope, comprising:

a display screen with fluorescent display cells arranged thereon in a matrix;

cathodes for emitting electrons, said cathode being disposed corresponding to said fluorescent display cells;

a first control electrode with openings corresponding to said fluorescent display cells made therein and positioned between said display screen and said cathodes;

second control electrodes, corresponding to each of said cathodes and oriented toward said cathode, disposed on a substrate which is located on the side of said cathodes opposite to said display screen; and third control electrodes disposed at both sides of said second control electrode;

said substrate with said cathodes, second control electrodes, and third control electrodes provided thereon, being arranged to be an insulating substrate floating above a back plate of said vacuum envelope, and said first control electrode being formed to have a cross-section in a U-shape and the edge portions thereof being extended so far as to reach the vicinity of said back plate.

11. A fluorescent display apparatus according to claim 10, wherein said first control electrode is held at a zero potential or negative potential level.

12. A fluorescent display apparatus according to claim 10, wherein the edge portions of said first control electrode are extended past the periphery of said insulating substrate to reach the vicinity of said back plate.

13. A fluorescent display apparatus according to claim 10, wherein leads from said cathodes and said first to third control electrodes are taken out to the back side of said back plate through a cut made in the edge portion of said first control electrode and a cut groove made in the edge portion of said insulating substrate.

* * * * *